US005150784A

United States Patent [19]

Sayad

[11] Patent Number: 5,150,784

[45] Date of Patent: Sep. 29, 1992

[54] COMBINATION BOTTLE CARRIER AND RACK

[76] Inventor: Fouad-Michel Sayad, 5360, Cote St. Luc Apartment 4, Montreal, Quebec, Canada, H3X 2C4

[21] Appl. No.: 746,347

[22] Filed: Aug. 16, 1991

[51] Int. Cl.[5] ..... B65D 75/00

[52] U.S. Cl. ..... 206/202; 206/45.14; 206/427; 211/74; 220/486; 220/511

[58] Field of Search ..... 206/201, 202, 45.14, 206/45.2, 45.24, 427, 174; 211/74; 220/486, 489, 511

[56] References Cited

U.S. PATENT DOCUMENTS

| | | | |
|---|---|---|---|
| 2,353,846 | 7/1944 | Power | 206/427 X |
| 2,396,003 | 3/1946 | Goldman | 206/202 X |
| 2,586,005 | 2/1952 | Colonna . | |
| 2,916,185 | 12/1959 | Skulavik | 206/202 X |
| 2,954,899 | 10/1960 | Skulavik | 206/174 |

FOREIGN PATENT DOCUMENTS

| | | | |
|---|---|---|---|
| 1092536 | 12/1980 | Canada . | |
| 1486279 | 6/1967 | France | 220/486 |
| 440117 | 2/1968 | Switzerland . | |

*Primary Examiner*—Bryon P. Gehman
*Attorney, Agent, or Firm*—George A. Seaby

[57] ABSTRACT

A structurally simple combination wine bottle carrier and rack includes three wire frames interconnected to define a skeletal, rectangular body with an open top end and partitions for receiving wine bottles, and a pair of U-shaped handles pivotally connected to the ends of the body for rotation of at least one of the handles through an arc in excess of 270° between an abutting carrier position above the center of the body and a rack position in which the handles extend outwardly from the top ends of the body for supporting the latter in a position in which the open top end thereof defines an acute angle with the horizontal for supporting bottles in an inclined position.

8 Claims, 2 Drawing Sheets

COMBINATION BOTTLE CARRIER AND RACK

BACKGROUND OF THE INVENTION

1. Field of the Invention

This invention relates to a combination bottle carrier and rack device.

While the device was designed particularly for wine bottles, it will be appreciated that the device can be used to carry and store virtually any type of bottle.

2. Discussion of the Prior Art

While wire or similar bottle carriers have long been available, very few, if any such carriers are suitable for use as stands or racks in which to store the bottles. It is the belief of the present inventor that a need exists for a combination bottle carrier and rack, particularly for use with wine bottles, since it is common practice to buy and store many bottles of wine at one time.

GENERAL DESCRIPTION OF THE INVENTION

The object of the present invention is to meet the above defined need by providing a relatively simple combination bottle carrier and rack device Accordingly, the present invention relates to a combination bottle carrier and rack device comprising body means including an open top end, side walls and a bottom wall; handle means pivotally connected to said body means for rotation from a vertical position above said body means through an arc of approximately 270° around a horizontal axis, between a carrying position above the top end of the body means and a position approximately parallel to the plane of said top end for supporting the body means in the stand position in which the plane of said top end defines an acute angle with the horizontal; and stop means for preventing rotation of said handle means beyond the rack position.

BRIEF DESCRIPTION OF THE DRAWINGS

The invention will be described in greater detail with reference to the accompanying drawings, which illustrate a preferred embodiment of the invention and wherein.

DESCRIPTION OF PREFERRED EMBODIMENT

Figure 1:
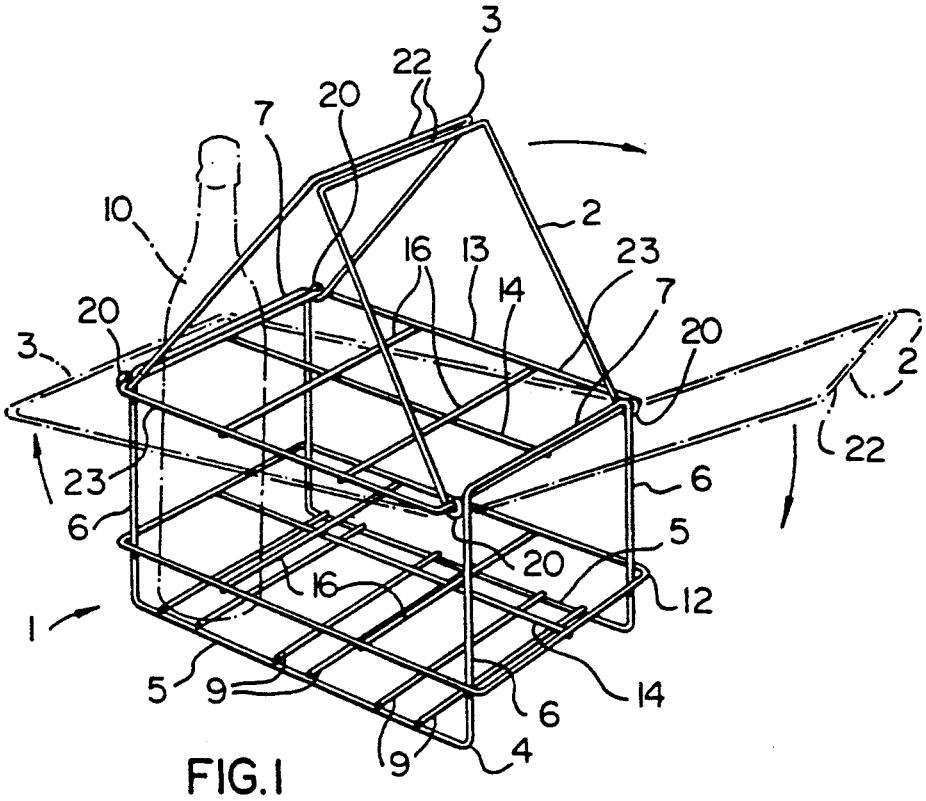
FIG. 1 is a perspective view from above and one end of a combination bottle carrier and rack device in accordance with the present invention in the bottle carrier condition.

With reference to the drawings, the bottle carrier and rack device of the present invention is formed of thick metal wire or plastic coated wire. The wire defines a rectangular parallelopipedic body generally indicated at 1 and a pair of handles 2 and 3.

The body includes a first endless wire frame 4, which defines the sides 5 of a base, the bottom ends 6 of generally U-shaped, parallel sides, and the sides and top ends 7 of a pair of generally inverted U-shaped, parallel ends. A plurality of parallel crossbars 9 extend between the sides 5 of the base to complete the latter. The crossbars 9 are arranged in pairs which are spaced apart a distance suitable for slidably receiving a neck of a wine bottle 10 (FIG. 2), while preventing passage of the body of a bottle therebetween. A pair of endless, rectangular wire frames 12 and 13 complete the body 1. The lower-most frame 12 extends around the frame 4 near the base thereof. The upper frame 13 is sandwiched between the top ends 7 of the frame 4. Centre bars 14 extend longitudinally between the ends of the frames 12 and 13, and crossbars 16 extend between the sides of such frames. The bars 14 and 16 in the frames 12 and 13 are aligned for defining partitions, which separate rectangular pockets for maintaining the bottles separate from each other in the body 1.

Figure 2:
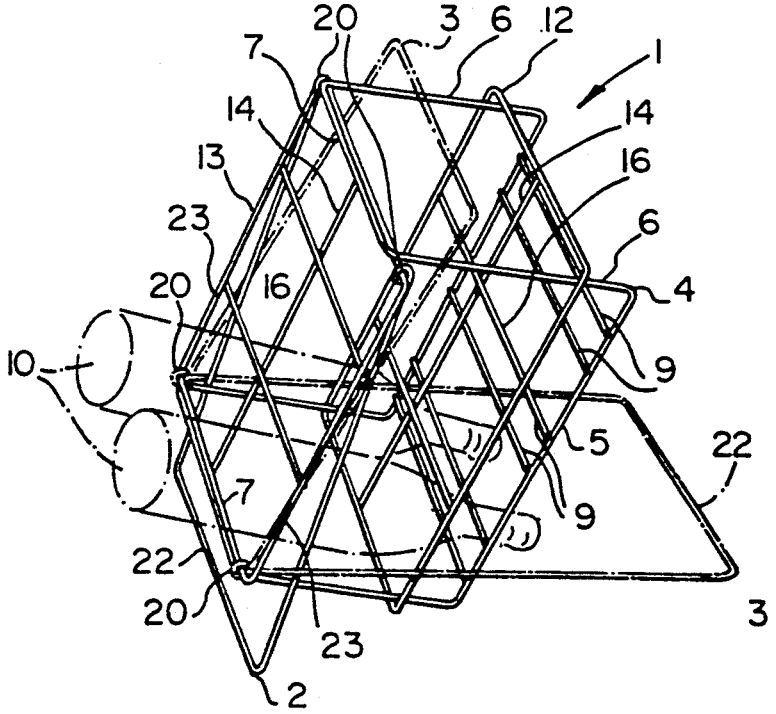
FIG. 2 is a perspective view of the device of FIG. 1 in the stand condition.

The handles 2 and 3, which are an inverted U-shape are pivotally connected to the ends of the top frame 13 outside of the ends 6 of the sides of the frame 4. For such purpose loops 20 are formed on each end of each arm of the handles 2 and 3. The handle 2 is slightly narrower than the handle 3, so that the handle 3 can be rotated over the handle 2 (FIG. 2).

During use as a bottle carrier, bottles 10 are inserted into the pockets defined by the bars 14 and 16, so that the bottom ends of the bottles rest on the crossbars 9 of the base of the body 1. The top ends 22 of the handles 2 and 3 are brought together as shown in solid outline in FIG. 1 for manual grasping and lifting of the bottle carrier.

One method of converting the device from the carrier position to a bottle stand or rack position includes the rotation of the handle 2 from the bottle carrier position over the end of the body 1 to which it is connected and through an arc of approximately 270° from the vertical around the body 1 to the stand position. The other handle 3 is rotated in the same manner over the other end of the body 1, and through an arc of approximately 270° from the vertical. The result is that the handle 2 extends outwardly from one end of the body 1, and occupies a plane almost parallel to the frame 13 defining the open top end of the body 1. In this position, the device can be placed on a flat surface, with the top 22 of the handle 2 engaging such flat surface, and the body 1 inclined so that the bottom ends of the frame 4 engage the flat surface and the frame 13 defines an acute angle with respect to the horizontal. The wine bottles 10 can be left in the position shown in FIG. 1 or they can be inserted into the pockets defined by the bars 14 and 16 so that the necks of the bottles are inclined downwardly between the crossbars 9. Obviously, one orientation of the bottles ensures that the corks are kept wet, but the other orientation prevents the attachment of sediments to the corks.

The sides 23 of the frame 13 extend outwardly a distance sufficient to prevent rotation of the handles 2 and 3 through the plane of the frame 13. In other words, the sides 23 of the frame 13 act as stops for the handles 2 and 3.

Figure 3:
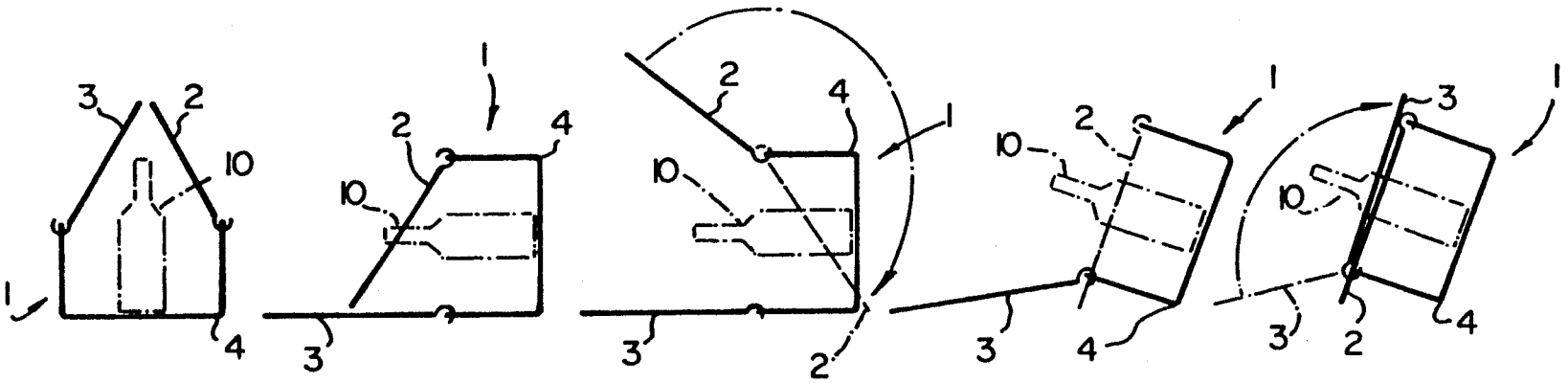
FIG. 3 is a series of schematic sketches showing a preferred method of converting the carrier of FIG. 1 to a rack.

Referring to FIG. 3, the preferred method of converting the bottle carrier of FIG. 1 to the stand or rack position includes the steps of (i) placing the carrier on its side with the handle 3 lying flat (ii) rotating the handle 2 around the bottom of the frame 4 through an arc in excess of 300° to beneath the end of the frame forming the base so that the frame 4 assumes the inclined stand position shown in the fourth sketch of FIG. 3, and (iii) rotating the handle 3 upwardly into overlapping relationship with the open front of the frame 4.

It will be appreciated that in its simplest form the device can include a single handle pivotally connected to the top centres of the sides of the body 1 for rotation around the body 1 to the stand position. The advantage of the two-handle device is that the second handle 3 can be used to carry the device when in the rack position. While wire or plastic coated wire is an obvious choice of material, because of the resulting design simplicity and low expense, it will be appreciated that the body and/or handles can be formed of other materials. For example, the body can be a one-piece molded structure, with plastic handles pivotally connected thereto.

I claim:

1. A combination bottle carrier and rack device comprising body means for carrying a plurality of bottles, said body means including an open top end, two sides, two ends and a bottom; handle means for carrying the device; stop means extending outwardly from said sides of said body means at the open top end thereof for limiting rotation of said handle means; said handle means being pivotally connected to said stop means for rotation around said stop means from a carrying position above the open top end of said body means, around one of said ends, around the bottom and around the other end of the body means to a rack position in which said handle means is approximately parallel to the plane of said top end for supporting the body means for use as a rack in a position in which the plane of the top end of the body means defines an acute angle with a horizontal support surface, said stop means preventing rotation of said handle means beyond the rack position.

2. A device according to claim 1, wherein said body includes first, one-piece wire frame means defining substantially U-shaped sides and inverted U-shaped ends of the body means; and second, one-piece wire frame means extending between the ends of said first frame means to define the periphery of said open top end and said stop means.

3. A device according to claim 2, wherein said second frame means extends beyond the sides of said first frame means for pivotally supporting said handle means and for defining said stop means.

4. A device according to claim 2, wherein said body means includes third wire frame means extending between the ends of said first frame means beneath said second frame means.

5. A device according to claim 4, including centre bar means and first crossbar means in said second and third frame means defining pockets for receiving bottles.

6. A device according to claim 5, including second crossbar means on said first frame means defining the bottom of said body means, said second crossbar means being spaced apart a distance sufficient to slidably receive the neck of a wine bottle while preventing passage of the body of the bottle.

7. A device according to claim 2, wherein said handle means includes a pair of generally U-shaped wire handles pivotally connected to the ends of said body means for rotation between a carrier position approximately above the centre of said body means and the rack position.

8. A device according to claim 7, wherein said second frame means extends beyond the side edges of said first frame means for pivotally supporting said handle means and for defining said stop means.

* * * * *